US006641079B1

(12) United States Patent
Siebenmann

(10) Patent No.: US 6,641,079 B1
(45) Date of Patent: Nov. 4, 2003

(54) WINDING DEVICE FOR FLEXIBLE, FLAT MATERIAL, ESPECIALLY PRINTED PRODUCTS

(75) Inventor: Dieter Siebenmann, Russikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/806,612

(22) PCT Filed: Aug. 10, 1999

(86) PCT No.: PCT/CH99/00369

§ 371 (c)(1),
(2), (4) Date: Mar. 29, 2001

(87) PCT Pub. No.: WO00/20314

PCT Pub. Date: Apr. 13, 2000

(30) Foreign Application Priority Data

Oct. 5, 1998 (CH) ..... 2023/98

(51) Int. Cl.[7] ..... B65H 39/14

(52) U.S. Cl. ..... 242/528; 242/541.3; 53/118; 53/430

(58) Field of Search ..... 242/528, 541.3, 242/352.4, DIG. 3; 53/118, 430

(56) References Cited

U.S. PATENT DOCUMENTS

| | | | | |
|---|---|---|---|---|
| 4,063,693 A | | 12/1977 | Achelpohl et al. | |
| 4,523,751 A | * | 6/1985 | Merkli | 270/60 |
| 4,526,362 A | | 7/1985 | Thierstein | |
| 4,676,496 A | | 6/1987 | Honegger | |
| 4,705,227 A | | 11/1987 | Honegger | |
| 4,871,125 A | | 10/1989 | Haueter | |
| 4,923,136 A | * | 5/1990 | Honegger | 242/528 |
| 5,622,027 A | | 4/1997 | Staub et al. | |

* cited by examiner

*Primary Examiner*—John Q. Nguyen
(74) *Attorney, Agent, or Firm*—Brinks Hofer Gilson & Lione

(57) ABSTRACT

The inventive winding device has a winding core (14) and a band spool (16), which are rotationally mounted on a frame (12). A supply (24) of the winding band (18) is wound onto the band spool (16). At the other end, the winding band is attached to the winding core (14). The winding core (14) is driven by its frictionally engaged interaction with a driving belt (32), which is driven by the drive motor (26). The drive motor (26) also drives the band spool (16).

11 Claims, 4 Drawing Sheets

WINDING DEVICE FOR FLEXIBLE, FLAT MATERIAL, ESPECIALLY PRINTED PRODUCTS

The present invention relates to a winding apparatus for flexible sheet-like arrangements, in particular printed products such as newspapers, periodicals and parts thereof, according to the preamble of claim 1.

A winding apparatus of this type is disclosed in EP-A-0 652 176 and in the corresponding U.S. Pat. No. 5,622,027. It has a winding core, which is mounted rotatably in a framework and can be driven by a drive shaft, and a winding band, which directs the flexible sheet-like arrangements essentially tangentially onto the winding core and is wound up onto the winding core together with the sheet-like arrangement. A drive train comprising a driving pulley, a drive belt and a drive belt pulley makes it possible for the rotary shaft, on which the winding core is mounted in a rotatable manner, to be rotated by the same drive motor as a band reel, from which the winding band is unwound during the winding up onto the winding core. Located between the winding core and the rotary shaft is a helical spring which is fastened, at one end, to the winding core and, at its other end, to the rotary shaft. The arrangement is such that the ends of the spring can move relative to one another in order to change the stressing state of the spring. The apparatus thus makes it possible for the torque to which the winding core is subjected to be adapted to the increasing roll diameter as the winding band is wound up onto the winding core together with the sheet-like arrangements, regulation not being necessary.

In a further winding apparatus for flexible sheet-like arrangements which is disclosed in EP-A-0 719 720 and in the corresponding U.S. Pat. No. 5,673,869, the roll rests circumferentially on endless supporting belts which can be driven by means of a drive motor. The band reel is connected in a rotationally fixed manner to a drive wheel. During operation, said band reel has a drive belt engaging around it, the drive belt, for its part, being driven by the drive motor. The drive belt and the drive wheel form a friction or slip clutch.

In a further winding apparatus known from CH-A-652 699 and the corresponding U.S. Pat. No. 4,587,790, the winding core and the band reel are arranged on a mobile framework. The latter can be attached alternately to a stationary winding-up station and unwinding station. The framework has a jaw brake in each case for the winding core and for the band reel. On the winding-up station, the winding core is connected to a drive motor of the winding-up station via an angular gear mechanism. During the winding up of the sheet-like arrangements onto the winding core, the jaw brake assigned to the band reel remains active in order to produce the necessary tensile stressing in the winding band. In the unwinding station, on the other hand, the band reel is driven by the drive motor via an angular gear mechanism, in which case the jaw brake assigned to the winding core remains active.

EP-A-0 243 837 and U.S. Pat. Nos. 4,768,768 and 4,928,899 disclose a winding apparatus in which the roll and the band reel are driven by the same drive motor. The latter drives frictional wheels which interact with the winding band on the circumference of the roll and on the circumference of the band reel.

It is an object of the present invention to provide a winding apparatus of the generic type which is of particularly straightforward construction.

This object is achieved by a winding apparatus which has the features of claim 1.

Frictionally locking connections are of particularly straightforward construction and allow coupling between the driving and the driven parts in an extremely straightforward manner. As the winding band is wound up onto the winding core together with the sheet-like arrangements, the drive part of the frictionally locking connection runs more quickly than the winding-core part, as a result of which the winding core, on account of the frictional locking, is subjected to a certain torque in the winding-up direction and, at the same time, the winding band is retained under tensile stressing. The same applies to the unwinding of the winding band from the unwinding core together with the sheet-like arrangements. In this case, the band reel is driven at a greater circumferential speed than the winding core. Both during the winding-up operation and during the unwinding operation, the winding core slips in relation to the part driving it.

Further preferred embodiments of the winding apparatus are specified in the dependent claims.

The invention will be explained in more detail with reference to an exemplary embodiment illustrated in the drawing, in which, purely schematically:

Figure 1:
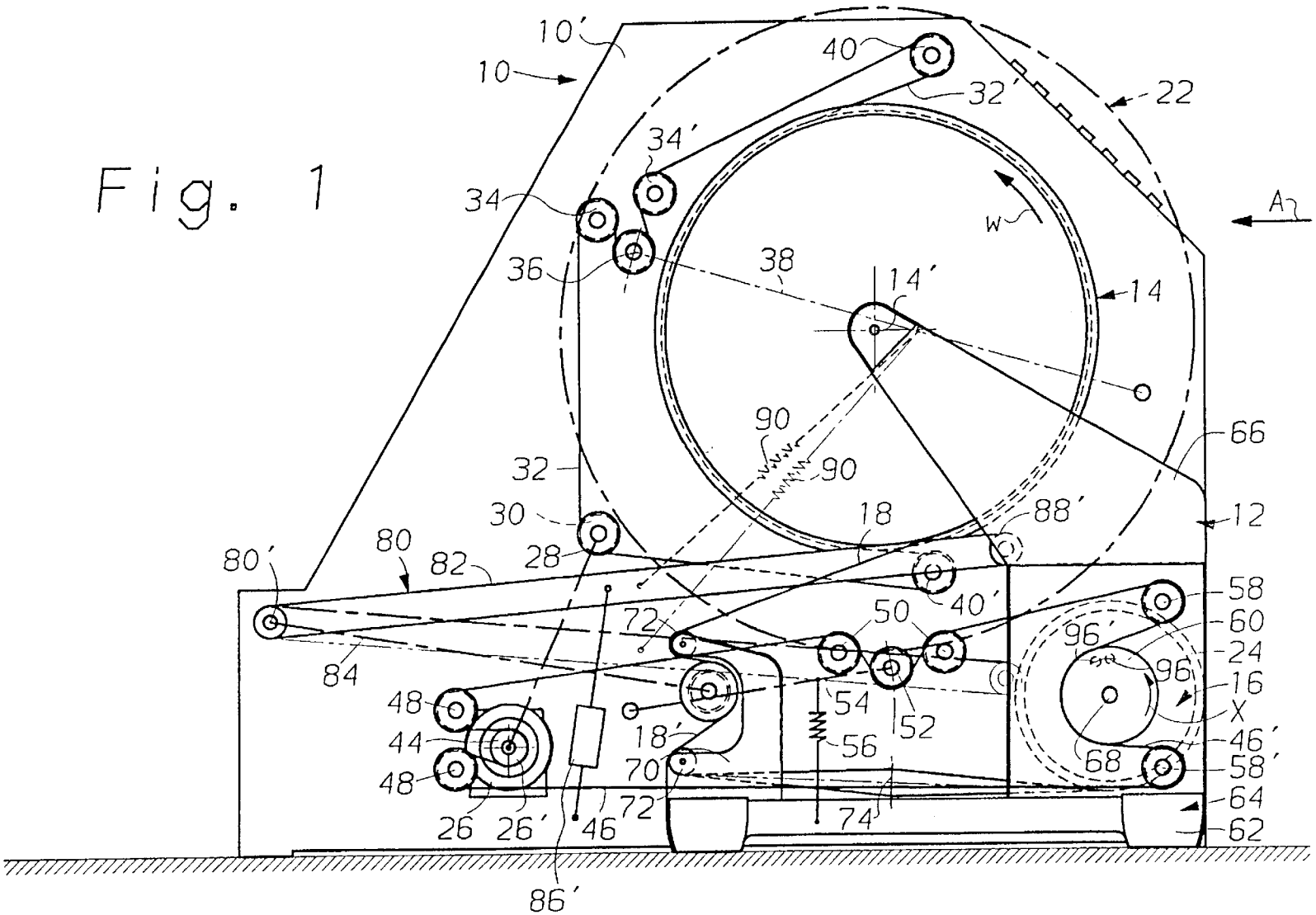
FIG. 1 shows, in elevation, a winding apparatus with a stationary winding station and a mobile framework which is attached thereto and has a winding core and a band reel.

The winding apparatus shown in the figures has a stationary winding station 10 and a framework 12 which can be attached to the winding station in the direction of attachment A and on which a winding core 14 and a band reel 16 are mounted in a freely rotatable manner. A winding band 18 is fastened, at one end, on the winding core 14 and, at the other end, on the band reel 16. In order to accommodate flexible sheet-like arrangements 20 arriving, for example, in an imbricated formation, in particular printed products such as newspapers, periodicals and parts thereof, the winding core 14 is intended for being driven about its axis of rotation 14' in winding-up direction W, the sheet-like arrangements 20 being wound up onto the winding core 14 together with the winding band 18, subjected to tensile stressing, to form a roll 22. In this case, the winding band 18 is unwound—counter to the arrow direction X—from a supply 24 wound up onto the band reel 16.

A single drive motor 26, both for driving the winding core 14 and for driving the band reel 16, is located in the stationary winding station 10. The output shaft 26' of the reversible drive motor 26 is connected rigidly to a drive roller 30 via a two-stage gear mechanism 28. Guided around said drive roller is an endless drive belt 32 for driving said gear mechanism. It should be mentioned that it is possible to dispense with the two-stage gear mechanism 28 if the winding station 10 is intended either just for winding-up purposes or just for unwinding purposes. From the drive roller 30, the drive belt 32 runs in the upward direction to a first deflecting roller 34, which is mounted in the stationary manner, and loops around the latter through approximately 180°. The drive belt 32 is then guided around a tensioning roller 36 which is mounted in a freely rotatable manner at the free end of a tensioning lever 38, which is mounted pivotably on the machine framework 10' of the winding station 10. From the tensioning roller 36, the drive belt 32 runs, once again, in the upward direction to a second deflecting roller 34', which is likewise mounted in a freely rotatable manner on the machine framework 10'. From said second deflecting roller, the drive belt 32 runs to a third deflecting roller 40, which is mounted on the machine framework 10' and is spaced apart from the second deflecting roller 34' counter to the direction of attachment A. Located vertically beneath the third deflecting roller 40 is a fourth deflecting roller 40', from which the drive belt 32 runs back to the drive roller 30. In the state in which the framework 12 is attached to the winding station 10—see FIGS. 1 and 3—the winding core 14 is located between the third and fourth deflecting rollers 40, 40', in which case the section 32' of the drive belt 32, said section being located between said drive rollers, butts against the lateral surface of the winding core 14 and encloses the latter through approximately 180°.

Figure 4:
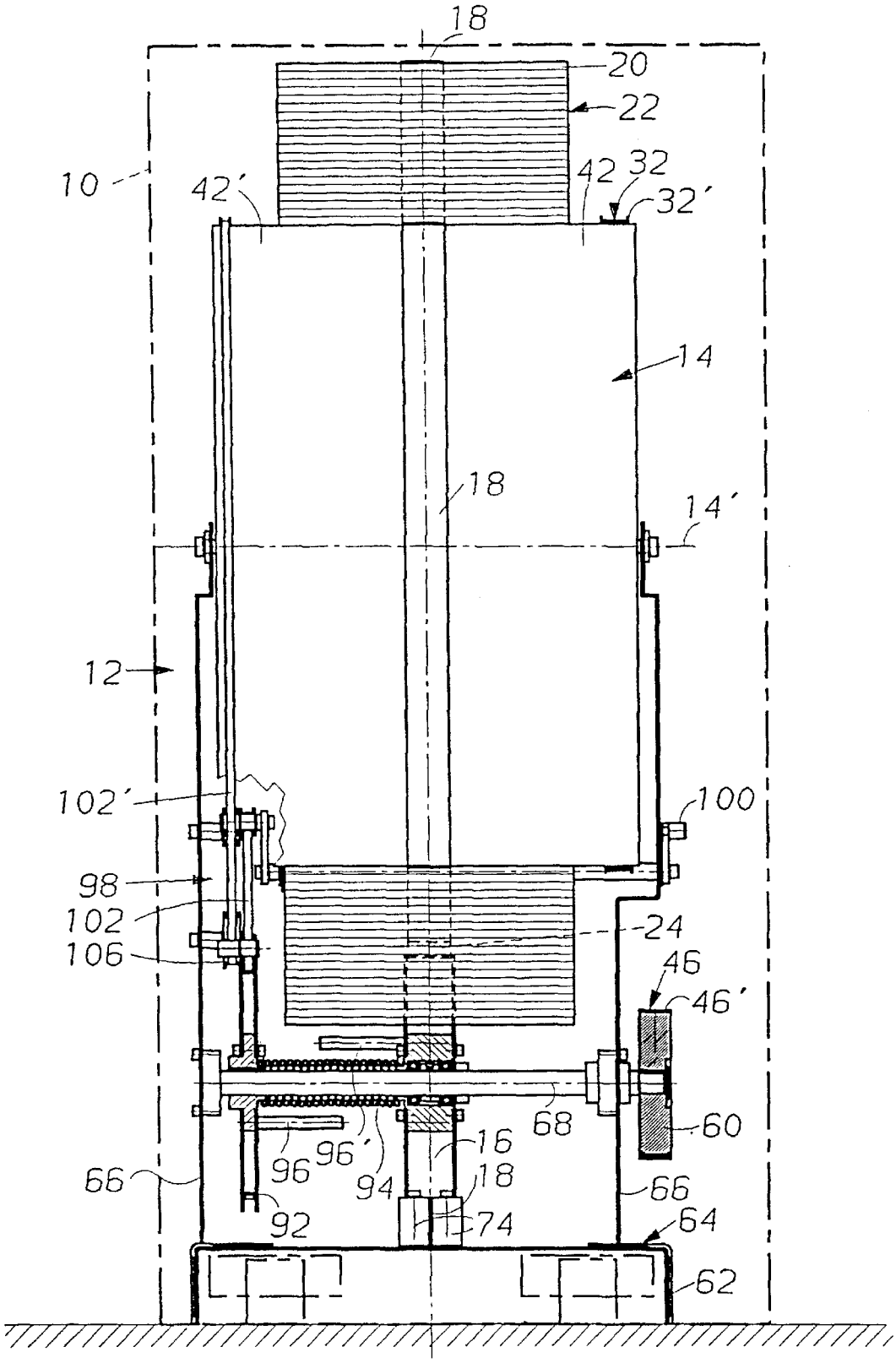
FIG. 4 shows the mobile framework in side view, and partially in section, a roll of sheet-like arrangements having been wound up onto the winding core.

As can be seen, in particular, from FIG. 4, the winding core 14 is designed to be wider, as seen in the direction of the axis of rotation 14', than the sheet-like arrangements 20 which are to be wound up onto it, with the result that it projects, by way of a lateral border region 42 or 42', beyond each side of the roll 22. In the border region 42, the drive belt 32 interacts in a frictionally locking manner with the winding core 14.

Figure 2:
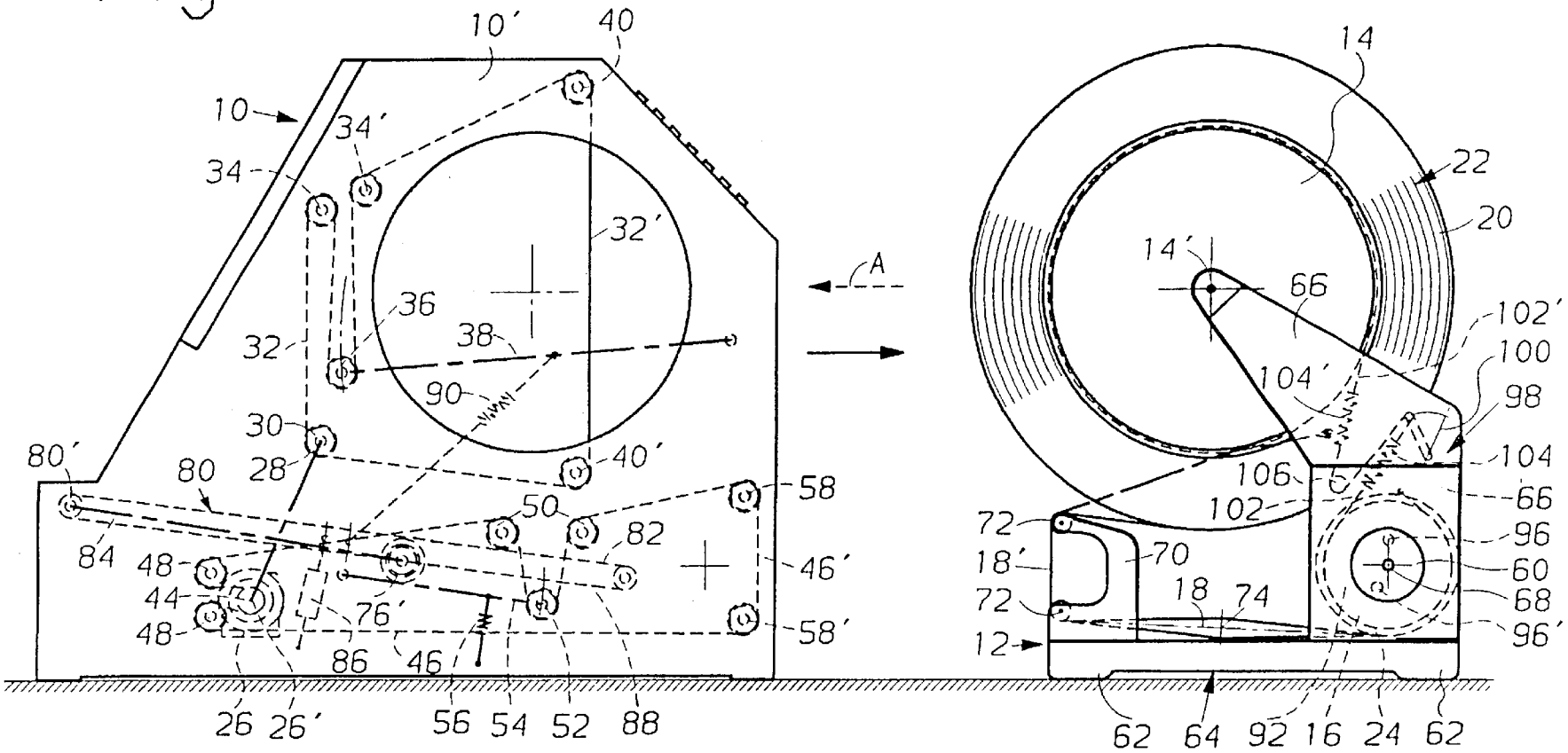
FIG. 2 shows, likewise in elevation, the stationary winding station and the framework which is detached therefrom and has a roll of sheet-like arrangements on the winding core and the band reel.

As can be gathered from FIG. 2, the section 32' of the drive belt 32 between the third and fourth deflecting rollers 40, 40' runs—with the framework 12 removed from the winding station 10—rectilinearly at least approximately in the vertical direction and thus transversely, if appropriate at right angles, to the direction of attachment A. For a length compensation, use is made of the tensioning roller 36 which, during detachment of the framework 12, moves in the downward direction and, during attachment, moves in the upward direction. The friction between the drive belt 32 and the winding core 14 is also determined by the force by which the tensioning roller 36 tensions the drive belt 32.

A toothed driven roller 44 is keyed onto the output shaft 26' of the drive motor 26, and guided around said driven roller is a continuous drive element in the form of a toothed belt 46 which, with its side which is directed away from the toothing, runs around two deflecting wheels 48 adjacent to the drive motor 26. From the top deflecting wheel 48 of these deflecting wheels, the toothed belt 46 runs, counter to the direction of attachment A, to a deflecting wheel of a pair of deflecting wheels 50 arranged one beside the other. Arranged between this pair of deflecting wheels 50 is a tensioning wheel 52 around which the toothed belt 46 is guided in a loop-like manner and which is mounted in a freely rotatable manner at the free end of a second tensioning lever 54. The latter, for its part, is mounted pivotably on the machine framework 10', by way of its end which is remote from the tensioning wheel 52, and is prestressed in the downward direction by means of a stressing spring 56, of which the fixed end is fastened on the machine framework 10'. From the pair of deflecting wheels 50, the toothed belt 46 continues, counter to the direction of attachment A, to a fourth deflecting wheel 58, beneath which a fifth deflecting wheel 58' is arranged. From the latter, the toothed belt 46 runs back to the bottom of the two deflecting wheels 48. In the state in which the framework 12 is attached to the winding station 10, the section 46' of the toothed belt 46, said section being provided between the fourth deflecting wheel 58 and the fifth deflecting wheel 58', runs approximately through 180° around a toothed reel drive wheel 60, with which the toothed belt 46 interacts in a positively locking manner.

As can be gathered, in particular, from FIG. 2, the section 46' of the toothed belt 46, with the framework 12 removed from the winding station 10, runs at least approximately in a vertical direction and thus transversely, if appropriate at right angles, to the direction of attachment A. As the framework 12 is detached from the winding station 10 counter to the direction A, the tensioning wheel 52 moves in the downward direction under the force of the stressing spring 56, as a result of which compensation for the change in length of the section 46' takes place. Conversely, during attachment, the tensioning wheel 52 is drawn in the upward direction.

The framework 12 has a base frame 64 which is provided with feet 62 and from which, in an upstream end region—as seen in the direction of attachment A bearing panels 66 from vertically upward, the top half of said panels running obliquely upward in the manner of extension arms in the direction of attachment A. In the free end region of the bearing panels 66, the winding core 14 is mounted such that it can be rotated freely about its axis of rotation 14'. Mounted in a freely rotatable manner on the bearing panels 66, in the bottom region of the same, is a rotary shaft 68 on which on the one hand—on the outside of the corresponding bearing panel 66—the reel drive wheel 60 is seated in a rotationally fixed manner and on which on the other hand—centrally between the bearing panels 60—the winding band reel 16 is mounted in a freely rotatable manner. See, in this respect, FIG. 4 in particular. The connection between the reel drive wheel 60 and the band reel 16 is described below.

A pair of bearing panels 70 of C-shaped design projects vertically upward from the downstream end region of the base frame 64, as seen in the direction of attachment A. Band-deflecting rollers 72 are mounted in a freely rotatable manner at the two leg ends. The winding band 18 runs in the attachment direction A, coming from the band reel 16, to the bottom of these band-deflecting rollers 72, a pair of rollers 74 which form a guide nip for the winding band 18 being arranged, such that they can be rotated freely about vertical axes, between said direction of attachment and the band reel 16. The pair of rollers 74 serves for the lateral guidance of the lateral band 18, the latter being twisted through 90° in each case between the band reel 16 and the pair of rollers 74, on the one hand, and between the pair of rollers 74 and the band-deflecting roller 72, on the other hand. In the state in which the framework 12 is attached to the winding station 10, there is located between the two band-deflecting rollers 72 a drive pulley 76 which is mounted in a freely rotatable manner on the machine framework 10' and which has the section 18' of the winding band 18, said section extending between the band-deflecting rollers 72, engaging around it. As can be gathered from FIG. 2, said section 18', with a framework 12 detached from the winding station 10, runs at least approximately in the vertical direction and thus transversely, if appropriate at right angles, to the direction of attachment A.

A belt conveyor 80 which is designed in the manner of a rocker is mounted on the machine framework 10' by way of one end such that it can be pivoted about a horizontal axis 80'. In order to drive the conveying belt 82 of said belt conveyor 80, the drive pulley 76 is connected rigidly for drive action to said conveying belt as is indicated with reference to the chain-dotted line 84. This drive connection 84 is designed such that the conveying belt 82 circulates at the same speed as the winding band 18 is moved. By means of a pneumatic compression spring 86 articulated on the machine framework 10', the belt conveyor 80 can be pivoted in the upward direction from a bottom rest position 88, which is indicated by dashed lines in FIG. 2 and by solid lines in FIG. 3, into an operating position 88', in which the conveying belt 82 butts from beneath, by way of a predetermined force, against the winding core 14 or against the roll 22 wound up onto the same, this obviously presupposing that framework 12 is attached to the winding station 10, see FIG. 1.

Fastened approximately centrally on the belt conveyor 80 is one end of a tension spring 90 which, at the other end, is articulated approximately centrally on the tensioning lever 38. This tension spring 90 serves for tensioning the drive belt 32 to a greater or lesser extent as the diameter of the roll 22 increases or decreases. This spring arrangement straightforwardly ensures that the tensile stressing in the winding band 18 remains approximately constant, irrespective of the diameter of the roll 22.

As can be gathered from FIG. 4, a blocking pulley 92 is keyed onto the rotary shaft 68. A helical spring 94, through which the rotary shaft 68 passes, is fastened, at one end, on the blocking pulley 92 and, at the other end, on the band reel 16. It is prestressed such that the band reel 16 is subjected to a torque acting in the winding-up direction X of the winding band 18. Projecting in the direction of the band reel 16 from the blocking pulley 92 is a first stop pin 96, which is intended for interacting with a mating stop pin 96' which projects in the direction of the blocking pulley 92 from the band reel 16. As can be gathered from FIG. 1, with the framework attached to the winding station 10, the stop pin 96 and mating stop pin 96' are in mutual abutment, it being the case that, as seen in the direction X in which the winding band 18 is wound up onto the band reel 60, the stop pin 96 trails in relation to the mating stop pin 96'. This ensures that the unwinding from, or the winding up onto, the band reel 16 of the winding band 18 takes place in accordance with the rotation of the drive motor 26 and thus in a drive-dominant manner. The helical spring 94 ensures that, with the blocking pulley 92 blocked, as the framework 12 is detached from the winding station 10, tensile stressing in the winding band 18 is maintained in that, as a result of the spring prestressing, the winding band 18 is wound up onto the band reel 16 in accordance with the shortening of the section 18', in which case the mating stop pin 96' moves away from the stop pin 96. Correspondingly, as the framework 12 is attached to the winding station 10, the winding band 18—with simultaneous stressing of a helical spring 94—is unwound from the band reel 16, the mating stop pin 96' coming into abutment against the stop pin again.

In order to block the blocking pulley 92, on the one hand, and the winding core 14, on the other hand, a braking arrangement 98 is arranged on the framework 12. As can be gathered from FIGS. 2 and 4, the braking arrangement 98 has a reversing lever 100 which is arranged on the framework 12 and on which two blocking belts 102, 102' are fastened by one end. One blocking belt 102 runs around the blocking pulley 92 and is fastened, at the other end, on the framework. Between the blocking pulley 92 and the reversing lever 100, the blocking belt 102 has a tension spring 104. The other blocking belt 102' runs from the reversing lever 100 to a deflecting roller 106 and, from the latter, around the winding core 14 to a fastening on the framework 12. This blocking belt 102' is intended for interacting with the border region 42' of the winding core 14. The blocking belt 102' likewise has a tension spring 104' between the deflecting roller 106 and the winding core 14. In the braking position of the reversing lever 100 shown in FIG. 2, the blocking belts 102, 102' are tensioned and block the winding core 14 and the blocking pulley 92 against rotation. Once the framework 12 has been attached to the winding station 10, the reversing lever 100 is pivoted into the release position in each case, as a result of which the tensile stressing in the blocking belt 100, 102', and thus the braking action thereof, is eliminated. Before the framework 12 is detached from the winding station 10, the reversing lever 100 is pivoted back into the braking position in each case.

Figure 3:
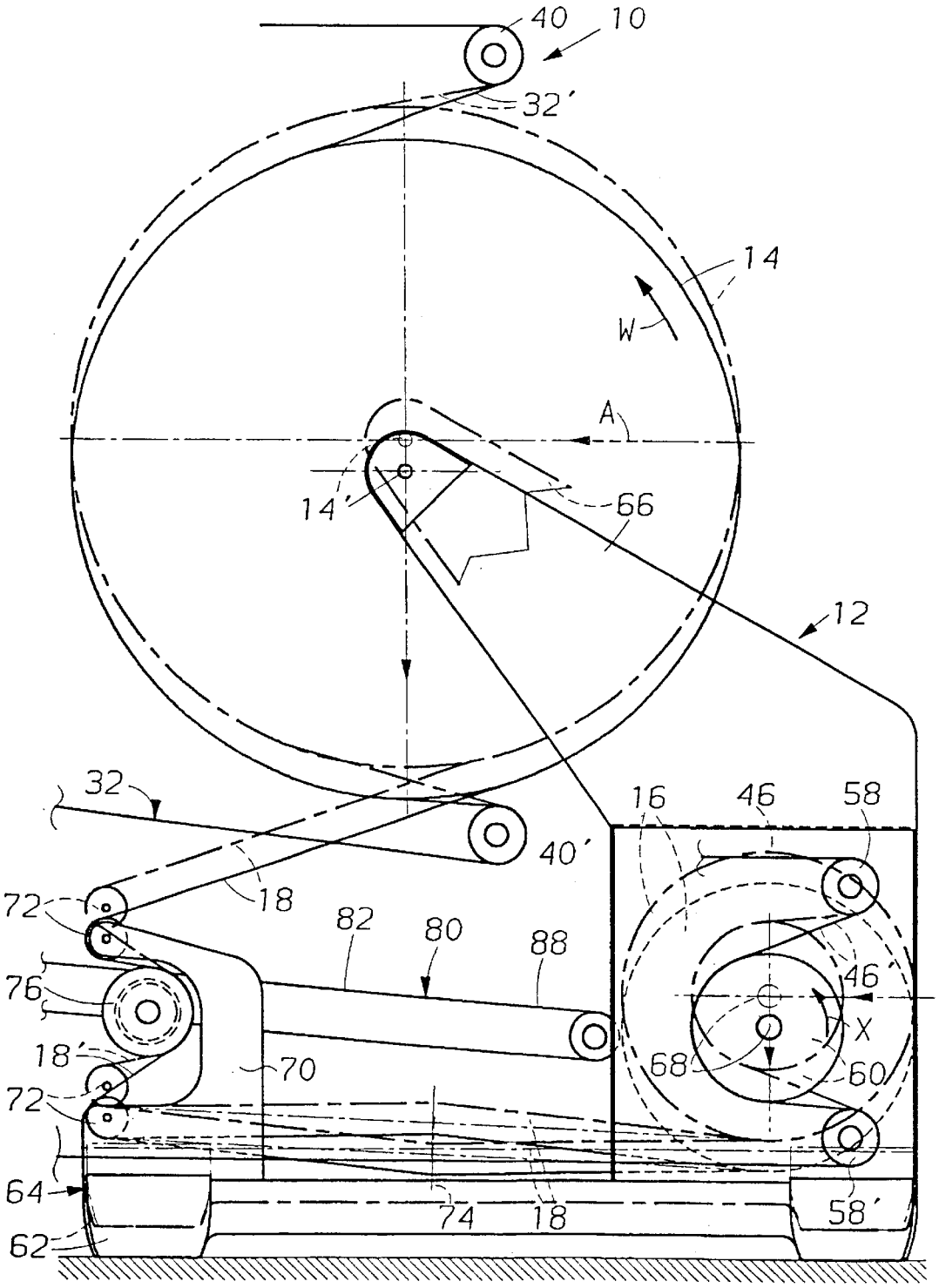
FIG. 3 shows, likewise in elevation and on a larger scale than FIG. 1, part of the winding station and the mobile framework during attachment, in chain-dotted lines, and in the attached state, in solid lines.

The framework 12 is intended, in order to attach it to, and detach it from, the winding station 10, for being raised by means of a fork-lift truck 108 which is known in general terms—and of which only the fork and wheels are indicated in FIG. 4—and then for being moved respectively in and counter to the direction of attachment A, and set down on the ground again, by means of said fork-lift truck. FIG. 3 uses solid lines to show the framework 12 in the attached state, set down on the ground, and the chain-dotted lines indicate the raised framework 12.

The departure point for the description of the functioning of the winding station 10 is the attached state, with empty winding core 14, shown in FIG. 1. The belt conveyor 80 has been advanced up to the winding core 14 from beneath by means of the pneumatic compression spring 86. In order to wind up the sheet-like arrangements 20 arriving, for example, in an imbricated formation, the drive motor 26 is set in motion in the clockwise direction. As a result, the winding core 14 is driven in the winding-up direction W, in the counterclockwise direction, and the band reel 16 is driven in the unwinding direction, counter to the arrow X. The speed of the drive belt 32 is greater here than the circumferential speed of the supply 24 wound up onto the band reel 16, with the result that the drive belt 32 slips in relation to the winding core 14. Furthermore, the torque to which the winding core 14 is subjected by the drive belt 32 is greater than the torque of the helical spring 94, with the result that the stop pin 96 and the mating stop pin 96' butt against one another. As a result, the band reel 16 is driven in a winding-dominant manner and the necessary tensile stressing in the winding band 18 is ensured.

The movement of the winding band 18 means that the conveying belt 82 is also driven, with the result that the arriving sheet-like arrangements 20, resting on said conveying belt, are fed to the winding core 14 beneath the latter. Since the winding band 18 runs tangentially onto the winding core 14 in the region of contact between the conveying belt 82 and the winding core 14, or adjacent to this region in the downstream direction, the sheet-like arrangements 20 are wound up onto the winding core 14 together with the winding band 18, subjected to tensile stressing, to form a roll 22. As a result of the increase in the diameter of the roll 22, the belt conveyor 80 is pivoted in the downward direction with its conveying belt 82 butting against the roll 22, which, as a result of the action of the tension spring 90, leads to a larger frictional force between the drive belt 32 and the winding core 14. This ensures that, even with the diameter of the roll 22 increasing, the tensile stressing in the winding band 18 remains at least approximately constant. Furthermore, the slippage also increases as the roll diameter increases.

As soon as the desired number of sheet-like arrangements 20 have been wound up onto the winding core 14, the drive motor 26 is brought to a standstill and the reversing lever 100 is reversed into the braking position. The blocking belts 102 and 102' are thus positioned, under tensile stressing, against the reel drive wheel 60 and the winding core 14, as a result of which the latter are blocked.

Furthermore, the belt conveyor 80 is lowered into the rest position 88 by means of the pneumatic compression spring 86.

A fork-lift truck 108 is then used to raise the framework 12 off the ground, from the position shown by solid lines in FIG. 3, into the position shown by chain-dotted lines in FIG. 3 and then to move it away from the winding station 10 counter to the direction of attachment A. In this case, the section 32' of the drive belt 32, the section 46' of the toothed belt 46 and the section 18' of the winding band 18 are straightened out. This takes place by the winding band 18 being wound up further onto the band reel 16 as a result of the prestressing of the helical spring 94. In this case, the mating stop pin 96' moves away from the stop pin 96. The change in length of the sections 32' and 46' is absorbed by a movement of the tensioning roller 36 and of the tensioning wheel 52 in the downward direction.

The framework 12, with the roll 22, may then be set down in an intermediate store to await further use of the sheet-like arrangements 20.

The winding station 10 is then ready for the attachment of a further framework 12 with empty winding core 14. This framework 12 is moved to the winding station 10, in the direction of attachment A, by means of a fork-lift truck. In this case, the winding core 14 is positioned against the section 32', the reel wheel 60 is positioned against the section 46' and the section 18' of the winding band 18 is positioned against the drive pulley 76. As a result of the winding band 18 then looping around the drive pulley 76, winding band 18 is unwound from the supply 24, as a result of which the band reel 16 is rotated in the unwinding direction, counter to the force of the helical spring 94. In this case, the mating stop pin 96' rotates towards the stop pin 96. The lengthening of the sections 32' and 461 is compensated for by the movement of the tensioning roller 36 and of the tensioning wheel 52. Once the reversing lever 100 has been moved into the release position, the drive motor 26, as has been described above, can then be set in motion in order to form a new roll 22.

The winding station 10 shown in the figures is also suitable for being used as an unwinding station. -For this purpose, the two-stage gear mechanism 28 can be reversed such that the drive belt 32 is driven at a speed which is lower than the circumferential speed of the band reel 16. The attachment of a framework 12 to a winding core 14 bearing a roll 22 takes place in precisely the same manner as the attachment of a framework 12 with an empty winding core 14. Once the belt conveyor 80 has been moved into the operating position 88', for the purpose of unwinding the sheet-like arrangements 20, the drive motor 26 is operated in the direction of rotation counter to that used for the winding-up operation. Since it is also the case here that the torque to which the winding core 14 is subjected by the drive belt 32—this torque acting as a braking torque during the unwinding operation—is greater than the torque exerted by the helical spring 94, the stop pin 96 and the mating stop pin 96' butt against one another, as a result of which, once again, the band reel 16 is driven in a winding-dominant manner. The sheet-like arrangements 20 are unwound from the roll 22 together with the winding band 18 and are conveyed away by means of the belt conveyor 88. The framework 12, with the empty winding core 14, can then be detached from the winding station 10, which is ready for accommodating a new framework 12 with a roll 22 on the winding core 14.

It is also conceivable to dispense with the stop pin 96 and mating stop pin 96'. In this case, an equilibrium is established between the torque of the helical spring 94 and the torque to which the winding core 14 is subjected by the drive belt 32.

Of course, it is also conceivable for the reel drive wheel 60 to be connected in a rotationally fixed manner to the band reel 16. In this case, the winding band 18 may be guided by way of a length-compensating apparatus which is constructed, for example, in the same way as, or similarly to, the length-compensating devices for the drive belt 32 and the toothed belt 46.

It is possible to dispense with a length-compensating apparatus for the winding band 18 if the belt conveyor 80 is driven directly by the drive motor 26.

Of course, it is also conceivable for the winding core 14 to be designed to be smaller, as seen in the direction of the axis of rotation 14', than the sheet-like arrangements 20 which are to be wound up. In this case, the winding core 14 is connected in a rotationally fixed manner to a pulley 110 which interacts with the drive belt 32.

Finally, it is also conceivable for the winding core 14 and the band reel 16 to be arranged in the stationary winding station 10. In this case, the 35 machine framework 10' serves for storing the winding core 14 and the band reel 16.

What is claimed is:

1. A winding apparatus for flexible sheet-like arrangements, in particular printed products such as newspapers, periodicals and parts thereof, comprising a winding core and a band reel, which are mounted rotatably on a mobile framework, a winding band that is fastend, at one end, on the winding core and, at the other end, on the band reel and, with simulanteous unwinding from the band reel, can be wound up on the winding core together with the sheet-like arrangememts, and under tensile stressing, and/or, with simultaneors winding up onto the band reel, can be unwound from the winding core, together with the sheet-like arrangements and under tensile stressing, single drive motor for driving both the winding core and the band reel, the drive motor being arranged in a stationary winding station, the mobile framework being attachable to the winding station, the drive motor driving an endless drive belt belonging to the winding station and a continuous drive element also belonging to the winding station, whereby, in the attached state of the framework, the drive belt butts against and interacts in a frictionally manner with one of a lateral surface of the winding core in a lateral border region and a pulley, which is connected in a rotationally fixed manner with said winding core, the drive element for driving the band reel being attached to a driving wheel connected with said band reel, and, during the winding operation the winding core or, respectively, the pulley, slips in relation to the drive belt.

2. The winding apparatus as claimed in claim 1, characterized in that the band reel is driven in a band winding direction.

3. The winding apparatus as claimed in claim 1 characterized in that the drive element is guided along a tensioning wheel.

4. The winding apparatus as claimed in claim 1, characterized by a belt conveyor which is designed in the manner of a rocker and has a conveying belt, which can be advanced up to the winding core or a roll of sheet-like arrangements arranged thereon and is drive-connected to a roller around which the winding band is guided for the purpose of driving the conveying belt.

5. The winding apparatus as claimed in claim 1, characterized in that the drive belt is guided around a tensioning roller.

6. The winding apparatus as claimed in claim 5, characterized in that a spring arrangement is provided between the tensioning roller and the belt conveyor in order to change the tensile stressing in the drive belt in dependence on the diameter of the roll.

7. The winding apparatus as claimed in claim 5, characterized in that the drive element comprises a toothed belt, which cooperates with the drive wheel in a positive fit manner.

8. The winding apparatus as claimed in one of claims 1, characterized in that there is arranged between the drive wheel and the band reel a prestressed spring which acts on the band reel in the winding-up direction and is prevented from being relieved of the resultant stress by a stop acting between the drive wheel and the band reel.

9. The winding apparatus as claimed in claim 1, characterized in that, with the framework removed from the winding station, a section of the drive belt runs transversely to the direction of attachment, with the result that at least part of this section is automatically positioned against the winding core when the framework is attached.

10. The winding apparatus as claimed in claim 1, characterized in that a reversible braking device is arranged on the framework in order to block the winding core and the band reel respectively the drive wheel.

11. The winding apparatus as claimed in claim 1, characterized in that a reversible braking device is arranged on the framework in order to block the winding core and the band reel respectively the drive wheel.

* * * * *